US007249763B1

(12) United States Patent
Moore et al.

(10) Patent No.: US 7,249,763 B1
(45) Date of Patent: Jul. 31, 2007

(54) PINCH ROLLER RETRACTION APPARATUS FOR A DOCUMENT PROCESSING SYSTEM

(75) Inventors: Michael J. Moore, Beverly Hills, MI (US); George T. Spray, Livonia, MI (US)

(73) Assignee: Unisys Corporation, Blue Bell, PA (US)

( * ) Notice: Subject to any disclaimer, the term of this patent is extended or adjusted under 35 U.S.C. 154(b) by 319 days.

(21) Appl. No.: 10/972,212

(22) Filed: Oct. 22, 2004

(51) Int. Cl.
*B65H 5/06* (2006.01)

(52) U.S. Cl. ..... 271/273; 399/124

(58) Field of Classification Search ..... 271/273, 271/274; 400/637.1; 235/475, 483–485; 399/124

See application file for complete search history.

(56) References Cited

U.S. PATENT DOCUMENTS

| | | | | |
|---|---|---|---|---|
| 4,630,815 A | | 12/1986 | Petersen et al. | |
| 5,158,280 A | * | 10/1992 | Sanchez | 271/274 |
| 5,419,546 A | | 5/1995 | Chen et al. | |
| 5,437,375 A | | 8/1995 | Chen et al. | |
| 5,439,506 A | | 8/1995 | Chen et al. | |
| 5,509,648 A | | 4/1996 | Chen et al. | |
| 5,671,919 A | | 9/1997 | Chen et al. | |
| 5,848,784 A | | 12/1998 | Tranquilla | |
| 5,908,191 A | | 6/1999 | Chen et al. | |
| 6,199,854 B1 | | 3/2001 | Tranquilla et al. | |
| 6,557,850 B1 | * | 5/2003 | Kallin et al. | 271/274 |
| 6,967,587 B2 | * | 11/2005 | Snell et al. | 340/686.6 |
| 6,993,268 B2 | * | 1/2006 | Otaka | 399/124 |
| 7,090,215 B2 | * | 8/2006 | Mandel et al. | 271/273 |

* cited by examiner

*Primary Examiner*—Patrick Mackey
*Assistant Examiner*—Jeremy R Severson
(74) *Attorney, Agent, or Firm*—Richard J. Gregson; Brooks Kushman P.C.

(57) ABSTRACT

A document processing system includes a feeder stage, a transport stage, and a retractable document handling mechanism cooperating with a portion of the document track. The mechanism includes an assertable member arranged with respect to the document track such that assertion of the member causes retraction of the opposed track walls in the cooperating portion of the document track by retracting a movable base member from a fixed base member. At least one pinch roller is affixed to the movable base member. The pinch roller engages the documents when the document handling mechanism is in the closed state, and the pinch roller is retracted to provide access to the document track when the document handling mechanism is in the retracted state.

8 Claims, 8 Drawing Sheets

PINCH ROLLER RETRACTION APPARATUS FOR A DOCUMENT PROCESSING SYSTEM

BACKGROUND OF THE INVENTION

1. Field of the Invention

The invention relates to document handling equipment including systems for feeding and transporting documents.

2. Background Art

A typical system for feeding and transporting documents includes a feeder in the document feeding portion of the system, and a series of roller pairs or belts in the document transporting portion of the system. In the feeding portion of the system, the feeder acts to separate and feed documents singly, in order, from a stack. In the transporting portion of the system, the roller pairs and/or belts convey the documents, one at a time, through a track past other processing devices such as readers, printers, and sorters that perform operations on the documents. The feeder is typically a feed wheel, but may take other forms. Further, the components in the transporting portion of the system may take a variety of forms. An existing document feeder is shown in U.S. Pat. No. 6,199,854. That patent describes a document feeder with a variable speed separator.

In existing systems for feeding and transporting documents, operations that depend on the position of the document are generally performed in the transport stage, or transporting portion of the system. For example, U.S. Pat. No. 5,848,784 describes a document separation apparatus. That patent describes the downstream acceleration/deceleration of documents with pinch rollers to adjust document spacing. U.S. Pat. Nos. 5,419,546; 5,437,375; 5,439,506; 5,509,648; 5,671,919; and 5,908,191 describe examples of other document operations.

Document sorting machinery, like check and letter sorters, is usually designed with a track and walls that guide documents down the track path. Drive rollers, with pinch rollers positioned opposite the drive rollers, usually drive the documents. The pinch rollers are usually spring loaded to provide force against the document, thus pushing the document against the drive rollers, propelling the documents down the path or track. Problems arise when documents jam or stops occur in the track due to a variety of reasons. The causes can be torn, damaged or mutilated documents, staples, folded edges, and other causes not related to the documents. For example, stops could be caused by a jam in a downstream module. When these jams and stoppages occur, operators are required to manually remove the documents from the track. This document clearing requires relieving the spring force of the pinch roller on the document against the drive roller.

Another problem of track accessibility occurs when the track has to be cleaned of paper debris and foreign matter like staples and rubber bands. Yet further problems occur when electronic devices positioned in or along the track require cleaning or maintenance or adjustments. The devices include, but are not limited to; magnetic read heads, pressure devices, optical and digital readers and cameras, bar code readers, printers, inkjets and other recognition devices. Drive and pinch rollers are usually in the same area as these devices to provide positive document drive. Drive and pinch rollers also require periodic cleaning due to ink and paper dust build-up on the document contact surfaces, again necessitating track accessibility.

Existing pinch roller retraction approaches in document handling equipment include levers, cams and other mechanisms that retract pinch rollers just enough to release the grip on the document. Other approaches include removable covers and lids, which expose the pinch rollers, and some may be retracted by hand, enough to relieve the spring pressure on the document. Yet other methods include manual track wall removal, when the pinch rollers are fastened to the track walls. The common problem with these approaches is that true and unrestricted access to the track and devices in and around the document track for document removal, cleaning, maintenance and adjustments is not provided. The existing approaches typically do not allow for true physical access, i.e., allowing an operator to reach his hand directly to the affected area, and also providing a visual line of sight to actually see the affected area. These existing approaches are time consuming, which directly has a negative impact on document throughput and productivity.

Additional background information may be found in U.S. Pat. No. 4,630,815.

For the foregoing reasons, there is a need for an improved mechanism for providing access to the track in a document processing system.

SUMMARY OF THE INVENTION

It is an object of the invention to provide an improved pinch roller retraction apparatus for a document processing system.

In carrying out the invention, a semi-automatic multiple pinch roller retraction apparatus is provided. The apparatus retracts multiple pinch rollers in response to the operator asserting a push button switch or other suitable assertable member. When the button is pushed, the multiple pinch rollers retract via a mechanism that is preferably spring assisted.

The pinch rollers retract to a position that provides physically unrestrictive access to the track for document removal, cleaning and maintenance, and device adjustment. When the pinch rollers are retracted, an operator can easily place his hand into the opened track and perform whatever tasks are necessary in a reasonable time frame.

Further, when the pinch rollers are in the retracted position, visual access is greatly increased and the operator can see directly into the document track, and would not have problems clearing documents, cleaning out debris or performing other maintenance procedures.

To close the apparatus, the machine operator pushes the retracted portion forward and the apparatus re-seats into a repeatable precise closed position. In a preferred implementation, during all of the open and close cycles, outer covers never have to be removed. In this same way, operation of the apparatus is ergonomically intuitive for any operator to use.

The apparatus enables increased document throughput due to less machine downtime, and also allows for maintenance procedures to be performed by machine operators as the operators have unrestricted access to the track, physically and visually.

In an alternative approach, a fully-automatic multiple pinch roller retraction apparatus for a document processing system may be provided. In this alternative, suitable sensors and/or system logic detects a problem and causes actuation of the retraction mechanism. The retraction mechanism may be driven by, for example, a servomotor. After an operator addresses the situation, the mechanism may be pushed forward until the apparatus re-seats into the repeatable precise closed position. As well, the closing process may also be fully or partially automated.

Advantages associated with various embodiments of the invention are numerous. For example, preferred embodiments include one or more retractable pinch rollers; a retraction mechanism and retractable base, and a release and repositioning device.

It is appreciated that in a preferred embodiment, there are four retractable pinch rollers, but any number of pinch rollers are possible. Further, the apparatus could be configured for any length or size, and the open position could be configured for different positions as needed.

DETAILED DESCRIPTION OF THE PREFERRED EMBODIMENTS

Figure 1:
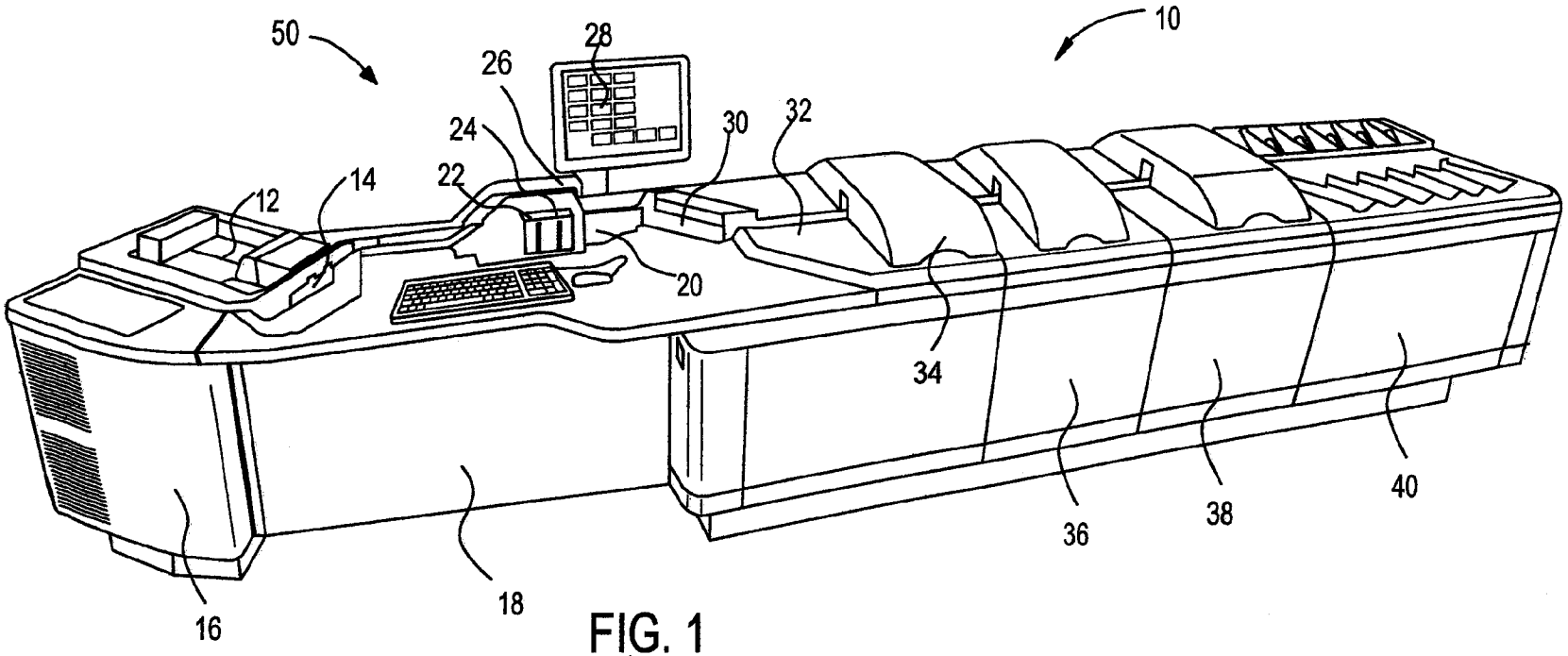
FIG. 1 illustrates a document processing system made in accordance with a preferred embodiment of the invention.

FIG. 1 illustrates a document processing system for feeding and transporting documents at 10. System 10 includes a primary feeder 12 and a secondary feeder 14. Cabinet 16 houses a computer running software for system 10. System 10 further includes removable kneewell panel 18. The feeders act to separate and feed documents singly, in order, from a stack. The remainder of the system is the transporting portion of the system, which includes a number of roller pairs and/or belts to convey the documents, one at a time, through a track past other processing devices that perform operations on the documents.

As shown in FIG. 1, a number of processing devices are located in the transporting portion of the system 10. Magnetic ink character recognition (MICR) reader 20 and optical character recognition (OCR) reader 22 are located in the document track following secondary feeder 14. As well, upstream imaging devices 24 and 26 image each passing document. The operator display is indicated at 28.

With continuing reference to FIG. 1, system 10 further includes a post-read view station 30, and a low-speed document encoder 32. As well, a multi-jet endorser (MJE) is located at 34. Further down the document track, an amount-only or full-field high-speed encoder 36 and downstream imager 38 process the passing documents. Finally, a 12-pocket stacker module 40 is provided for the actual sorting of the documents into pockets. The drawings illustrate the preferred embodiment, which is depicted as an NDP Quantum Series transport available from Unisys.

Figure 2:
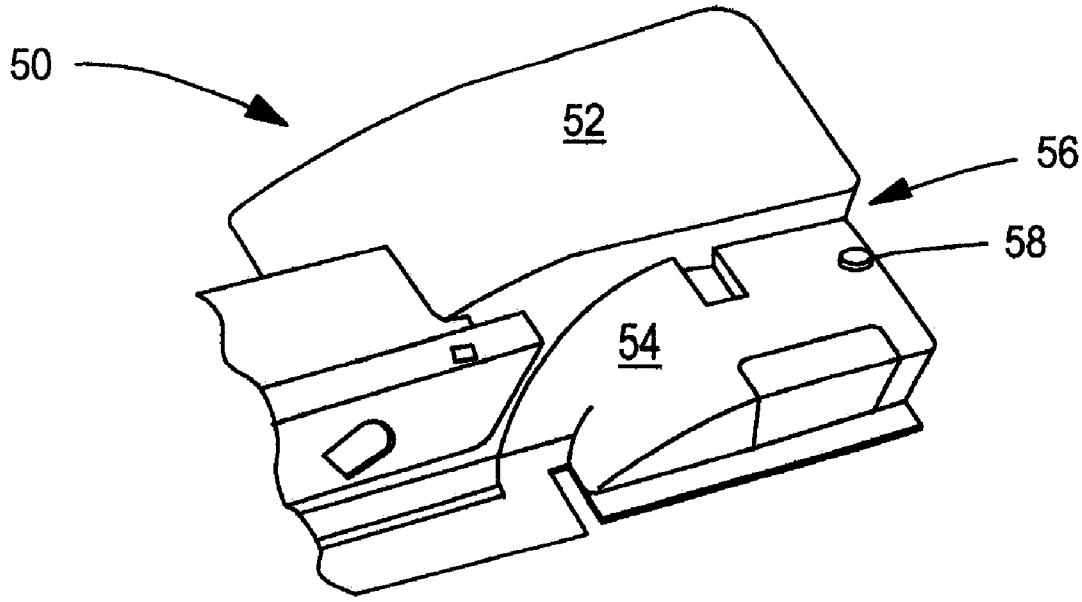
FIG. 2 is an enlarged view of the semi-automatic document handling mechanism.
Figure 3:
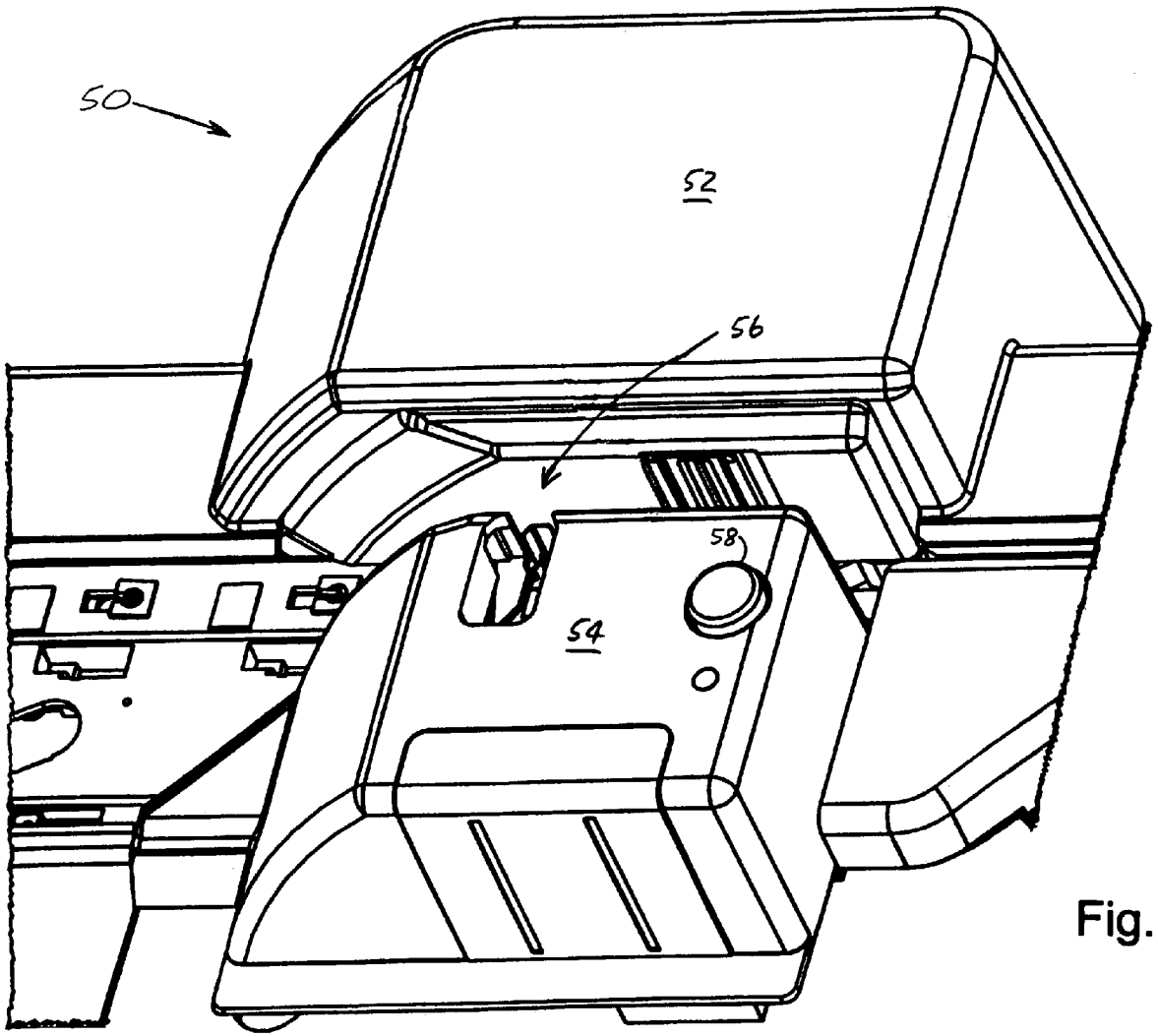
FIG. 3 shows the semi-automatic document handling mechanism in the open position.
Figure 4:
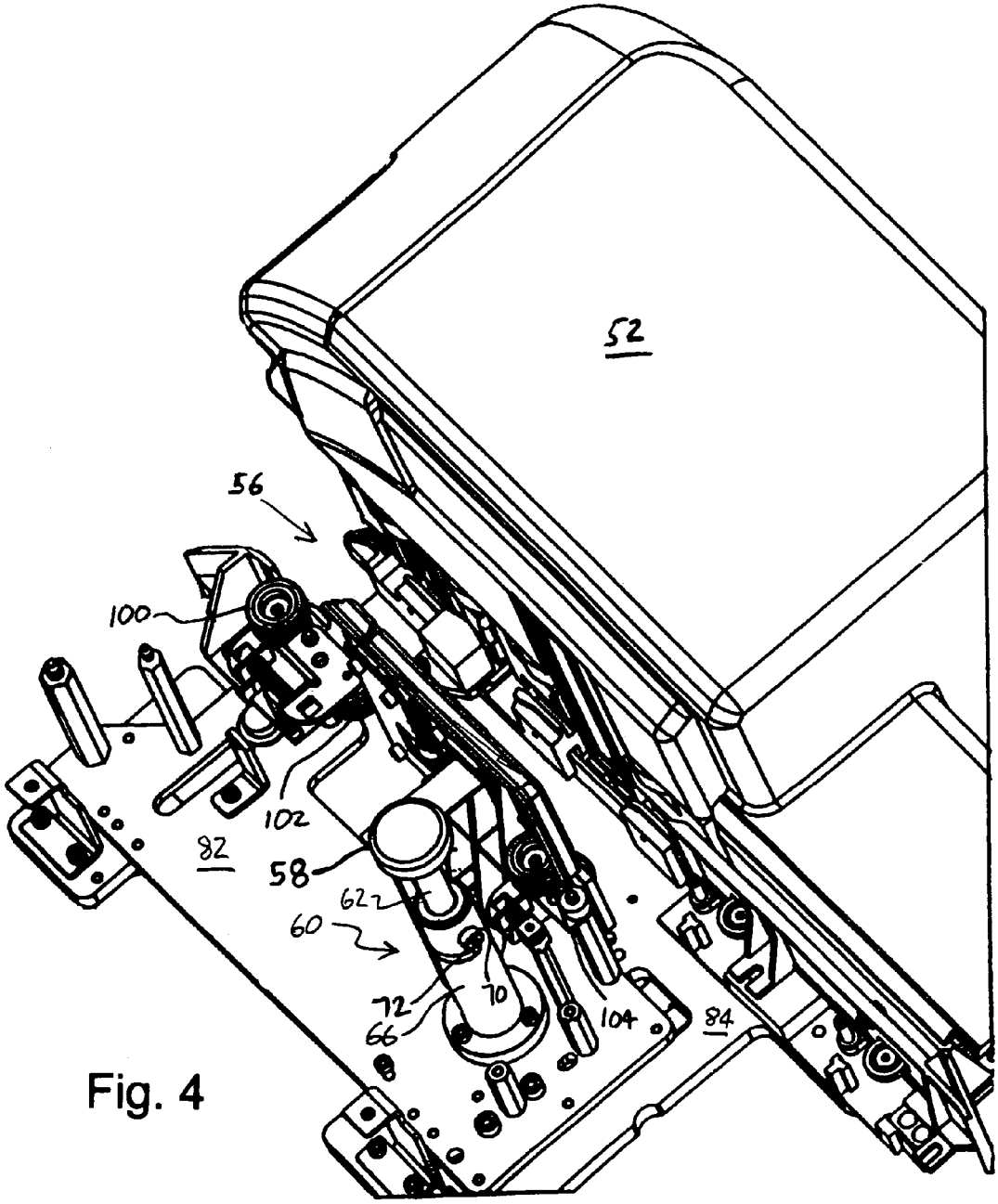
FIG. 4 shows the semi-automatic document handling mechanism in the open position with the cover removed, showing clear visual and physical access to the track.
Figure 5:
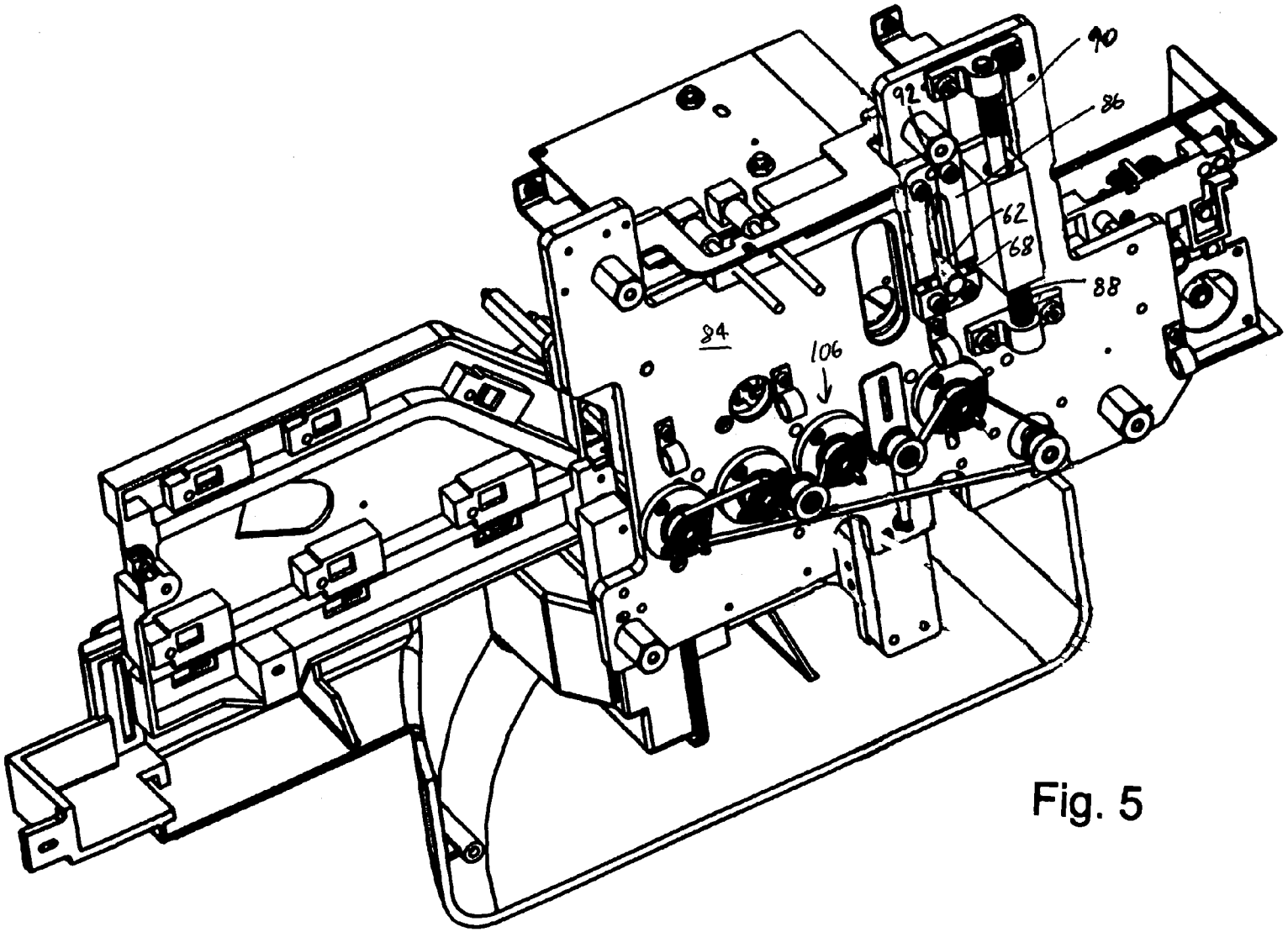
FIG. 5 shows the semi-automatic document handling mechanism from the bottom.
Figure 6:
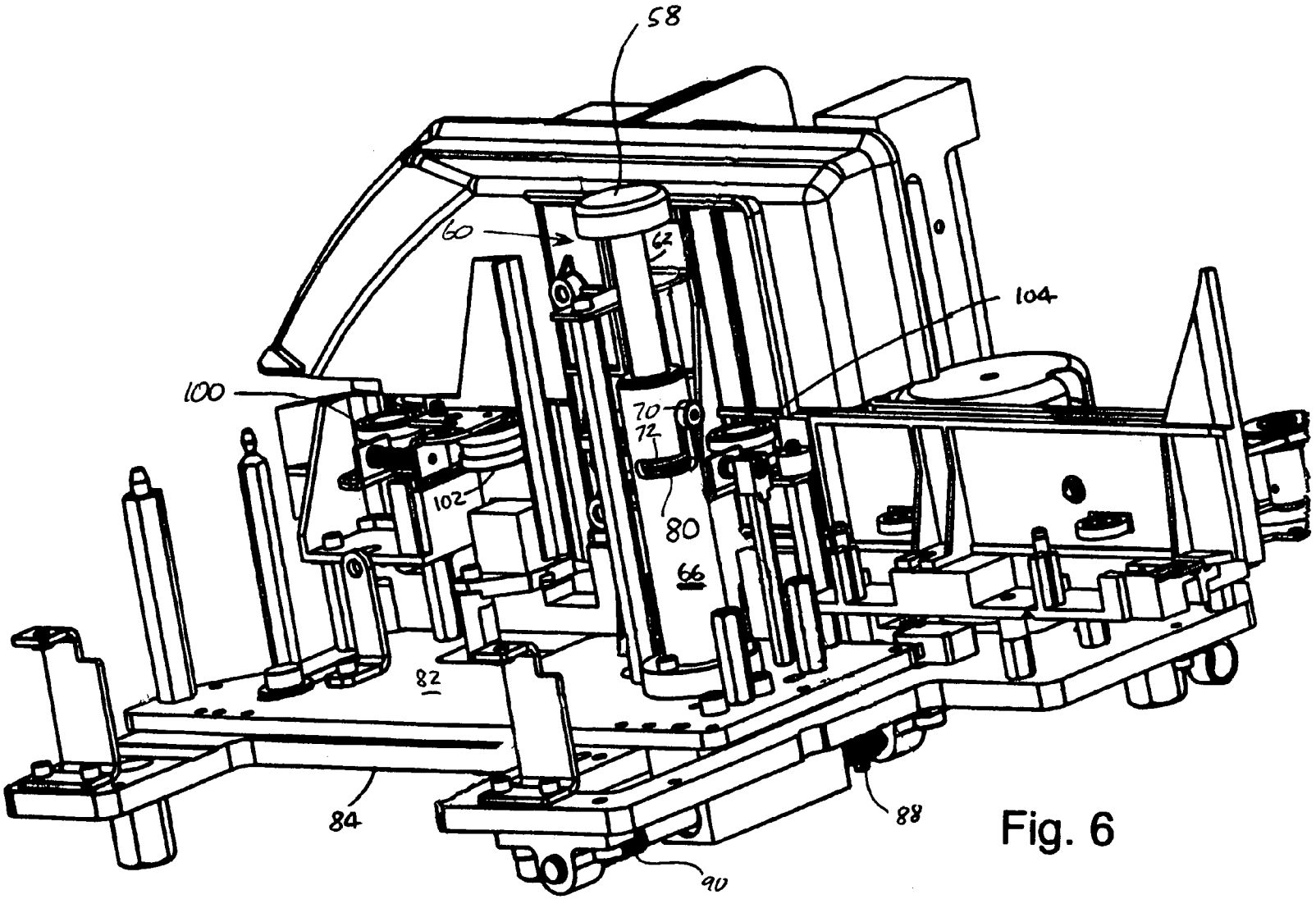
FIG. 6 is another view of the semi-automatic document handling mechanism; in this view the precision locating mechanism is more clearly visible.
Figure 7:
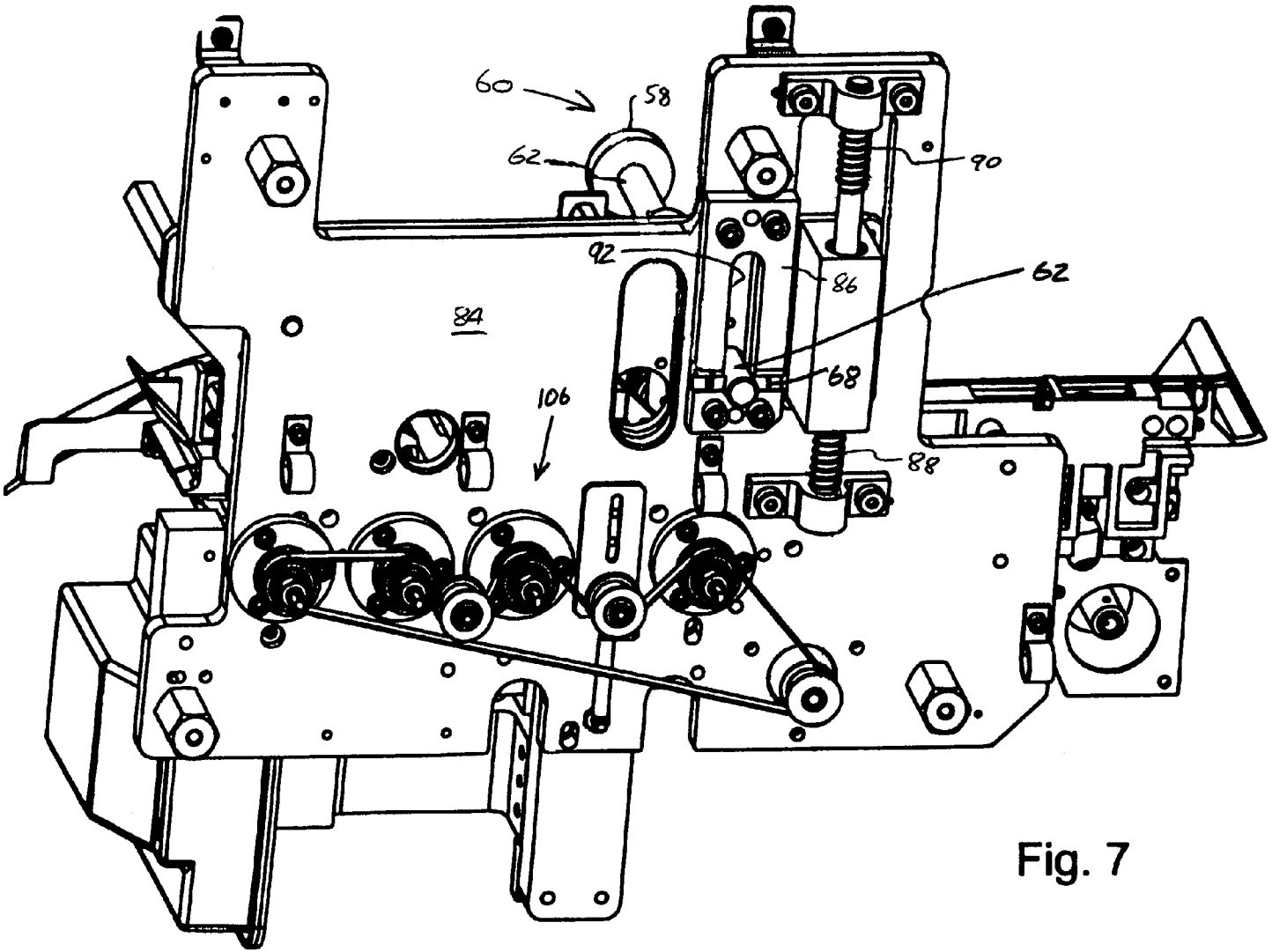
FIG. 7 is another view of the semi-automatic document handling mechanism from the bottom.

FIG. 2 illustrates the semi-automatic document handling mechanism at 50. Each half of the mechanism has a cover 52,54, and the track area is indicated at 56. Push button 58 is asserted to cause the mechanism to retract, opening up the track area for operator access. FIG. 3 shows the semi-automatic document handling mechanism in the open position.

FIGS. 4-7 illustrates various components of the semi-automatic document handling mechanism in the preferred embodiment, in greater detail. With continuing reference to these figures, the improved retractable document handling mechanism 50 provides access to the track area 56 in the document processing system 10. The mechanism provides the capability for the machine operator to open the track area 56 by depressing the push button 58. Pressing push button 58, in turn, activates a mechanism that retracts the rigid document track walls. The track open distance is set so that an operator can easily remove document jams, remove stopped documents, remove staples and paper debris, and perform routine maintenance or device adjustment.

Advantageously, the operator has a direct line of sight to the track bottom. Advantageously, covers 52 and 54 do not have to be removed. The machine operator closes the semi-automatic retractable document handling mechanism 50 by pushing cover 54 until the precision locating device locks the mechanism in the closed position. The entire open and closing cycle is quick and easy and is a positive improvement on efficient operations and document throughput. This mechanism directly reduces machine downtime.

In more detail, by depressing button 58, repositioning device 60 is actuated. Button 58 pushes a connecting rod 62 that is located in a housing 66 and is guided by two precision bushings. At the opposite end of connecting rod 62 is a precision pin 68 pressed into connecting rod 62 at a 90° angle. Connecting rod 62 also has a tapped hole with a locating counterbore that receives a shoulder screw 70 that passes through a special slot 72 on housing 66.

This feature provides anti-rotation and use, yet can still be rotated 90° for assembly purposes in the fully depressed mode of assembly 60. Connecting rod 62 has compression spring 80 acting on it to urge button 58 to the deasserted or upward position. The entire repositioning device 60 rests and is positioned on a moving base 82. Pin 68 on the end of connecting rod 62 nests in a groove in slot 92 on a wear plate 86 mounted on fixed base 84 (in the closed position).

This arrangement gives the precision location needed to properly locate the track walls for operation. Depression of connecting rod 62 by pushing button 58 causes pin 68 to clear the groove in slot 92 in wear plate 86, and allows for the moving base 82 to retract by means of an assist spring 88. A counter spring 90 acts as a dampener and absorbs any potential mechanical shock during the semi-automatic opening of the retraction mechanism. Wear plate 86 has slot 92 through the center of wear plate 86 to allow for travel of moving base 82. The wear plate 86 is preferably constructed of hardened tool steel to provide long life and also has a surface finish that provides a low coefficient of friction, as the locating pin 68 slides back and forth on the surface.

The operator closes the re-positioning device by simply pushing the retracted assembly forward, and the pin 68 snaps into the groove, giving the repeatable location necessary for proper track gaps, sensor alignment and for alignment of other electronic devices including, but not limited to, magnetic read heads and pressure devices, drive and pinch rollers, optical cameras and the like. Advantageously, cover removal is not required to open the apparatus, access the track, and close the apparatus back to the precision location.

The semi-automatic re-positioning device for the document handling apparatus 10 can be opened and closed in seconds and gives true and unrestrictive access to the document track area 56. The device allows easy document removal by the operator and allows the operator to perform maintenance previously done by field engineers. The device reduces machine downtime and enables increased document throughput.

In addition to the advantages described above, it is appreciated that the apparatus retracts multiple pinch rollers upon the machine operator pressing button 58. When button 58 is pushed, multiple pinch rollers retract via the spring-assisted mechanism. As shown, pinch rollers 100,102,104 retract to a position that provides physically unrestricted access to the track area 56 for document removal, cleaning and maintenance, and device adjustment.

An operator can easily put his hand into the track and do whatever tasks are necessary in a very short time frame. The operator can see directly into the track and would have no problem clearing documents, cleaning out debris or performing other maintenance procedures.

To close the apparatus, the machine operator pushes cover 54 forward and the retracted assembly snaps back into a repeatable precise closed position. The operation of the apparatus is ergonomically intuitive for any machine operator to use. The apparatus not only enables increased document throughput due to less machine downtime but allows for maintenance procedures to be performed by the operators instead of field engineers.

Figure 8:
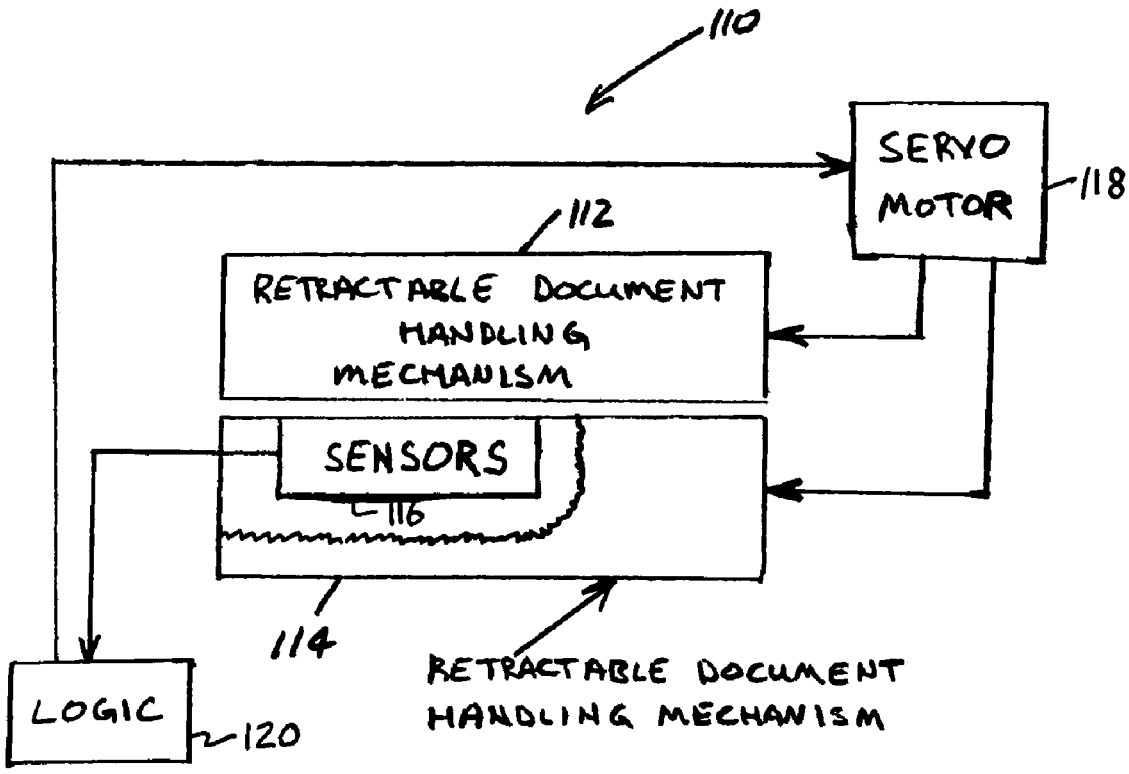
FIG. 8 illustrates a fully-automatic document handling mechanism that is used in alternative embodiments of the invention.

FIG. 8 illustrates a fully-automatic document handling mechanism 110 that is used in alternative embodiments of the invention. As with the other described embodiment, the mechanism includes first and second halves 112 and 114 where one part of the handling mechanism forms the fixed base while the other part of the handling mechanism forms the movable base. Sensors 116 and system logic 120 are configured to detect a problem occurring in the cooperating portion of the document track. Detection of a problem causes actuation of the retraction mechanism, which is shown being driven by servomotor 118. After an operator addresses the problem situation, the mechanism may be manually urged back together until the precision locating device locks the mechanism into closed position. In addition, the closing process may also be partially or fully automated.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A document processing system for feeding and transporting documents, the system comprising:

a feeder stage including a hopper assembly and a feeder wherein the feeder acts to feed documents singly, in order, from a stack of documents in the hopper assembly;

a transport stage downstream of the feeder stage for receiving the fed documents, the transport stage including a document track composed of a pair of opposing rigid track walls wherein, during transportation, the documents are moved along the document track in a series to allow operations to be performed on the documents;

a retractable document handling mechanism cooperating with a portion of the document track and including a movable base member which carries one side of the document track and a fixed base member that carries the other side of the document track;

at least one pinch roller affixed to the movable base member;

an assertable member configured such that assertion causes retraction of the opposing track walls in the cooperating portion of the document track by retracting the movable base member, thereby providing access to the document track, the retraction being sufficient to provide a track opening sufficient to allow the operator to relieve document jams;

wherein the retraction motion of the movable base member is linear such that the opposed track walls remain aligned with each other during opening and closing of the document track to provide a repeatable precise closed position;

wherein the at least one pinch roller engages the documents when the document handling mechanism is in the closed state;

wherein the at least one pinch roller is retracted to provide access to the document track when the document handling mechanism is in the retracted state;

a precision locating device affixed to the movable base;

a mating component on the fixed base such that the mating component interlocks with the precision locating device when the track is in the closed state;

wherein the precision locating device and the mating component comprise a pin and groove arrangement; and wherein the precision locating device includes a connecting rod and includes the pin, and wherein the mating component includes a wear plate including the groove, the wear plate defining a slot through which the connecting rod extends, the slot being linear to cause the retraction motion of the movable base member to follow a linear path during retraction while providing the repeatable precise closed position.

2. The system of claim 1 wherein the pair of opposing rigid track walls includes a series of track sections cooperating to form the document track.

3. The system of claim 1 wherein the retraction is sufficient to provide a direct line of site to a bottom of the track when the retractable document handling mechanism is in the retracted state.

4. The system of claim 1 wherein the retractable document handling mechanism includes a mechanical spring and lock arrangement wherein, in response to the assertion of the assertable member, the arrangement unlocks and the spring causes the retracting of the movable base member.

5. The system of claim 1 wherein the retractable document handling mechanism includes a sensor and servomotor arrangement wherein, in response to the sensor detecting a fault condition, the servomotor causes the retracting of the movable base member.

6. The system of claim 1 wherein the assertable member is a push button.

7. The system of claim 1 further comprising:

an assisting spring that urges the movable base member away from the fixed base member to cause the retractable document handling mechanism to retract the opposing track walls upon assertion of the assertable member.

8. The system of claim 7 further comprising:

a dampening spring to dampen the opening movement of the retractable document handling mechanism.

* * * * *